US006652353B1

(12) United States Patent
Lund et al.

(10) Patent No.: US 6,652,353 B1
(45) Date of Patent: Nov. 25, 2003

(54) INTERACTIVE TOY

(75) Inventors: Bruce D. Lund, Chicago, IL (US); Sunil Moothedath, Chicago, IL (US)

(73) Assignee: Lund and Company, Chicago, IL (US)

( * ) Notice: Subject to any disclaimer, the term of this patent is extended or adjusted under 35 U.S.C. 154(b) by 0 days.

(21) Appl. No.: 10/162,347

(22) Filed: Jun. 5, 2002

(51) Int. Cl.[7] ..... A63H 7/00

(52) U.S. Cl. ..... 446/356; 446/297; 446/390; 446/484; 446/330

(58) Field of Search ..... 446/175, 297, 446/298, 299, 300, 301, 302, 303, 356, 353, 352, 370, 373, 369, 390, 484, 486, 397, 330

(56) References Cited

U.S. PATENT DOCUMENTS 1,551,250 A * 8/1925 Henry ..... 446/370
1,822,437 A * 9/1931 Fleming ..... 446/373
2,896,948 A * 7/1959 Brodrib ..... 446/373
3,452,473 A * 7/1969 Convertine ..... 446/353
4,355,482 A * 10/1982 Sapkus et al. ..... 446/279
5,176,560 A * 1/1993 Wetherell et al. ..... 446/175
5,820,441 A * 10/1998 Pracas ..... 446/354
6,129,606 A * 10/2000 Yuen ..... 446/325
6,462,498 B1 * 10/2002 Filo ..... 446/356

* cited by examiner

*Primary Examiner*—Derris H. Banks
*Assistant Examiner*—Urszula M Cegielnik
(74) *Attorney, Agent, or Firm*—Jack Shore

(57) ABSTRACT

An interactive toy in accordance with the present invention includes two pair of legs extending outwardly and downwardly from either side of a body to be in contact with a surface. Each pair of legs is rotatably attached to a motor. The toy also includes a sound activation device in communication with an integrated circuit. The integrated circuit is further in communication and control of the motors such that when the sound activation device is activated, the integrated circuit controls the motors to rotate the legs. The direction of the rotation of the legs will cause the toy to move along the surface in a predefined direction, defined as forward, reverse, or spinning to the right of left.

14 Claims, 5 Drawing Sheets

INTERACTIVE TOY

BACKGROUND OF THE INVENTION

Interactive toys have been the mainstay for young children for a long time. There have been numerous varieties of interactive toys from toys that interact when placed in certain positions to toys that interact to other toys. There exist interactive toys that speak, walk, skate, and move in response to a child touching or squeezing various parts of the toy, as well as in response to movement and sound. However, there is always a continual need for improvements and new and novel features.

SUMMARY OF THE INVENTION

In accordance with the present invention an interactive toy is provided herein. The toy includes a body that has a defined left and right side. A pair of motors contained therein is also positioned separately on the left and right side. Attached to each motor is a pair of legs that extend outwardly and downwardly such that each foot comes in contact with a surface. When the motors are activated, preferably in response to sound, the motors rotate the legs such that the rotation of the feet, attached to each leg, moves the toy either forward or reverse, or spins the toy to the right or left.

The forward and reverse movement is controlled by rotating the pair of legs on one side of the body in the opposite direction to the pair of legs on the other side of the body. Thus when the legs attached to the motor on the right side of the body rotate counterclockwise and the legs attached to the motor on the left side of the body rotate clockwise, the toy moves in a forward direction. Alternatively, when the legs attached to the motor on the right side of the body rotate clockwise and the legs attached to the motor on the left side of the body rotate counterclockwise, the toy moves in a reverse direction.

Spinning motion is created by rotating both pairs of legs in the same direction. When the legs are rotated in a clockwise direction, the toy spins to the right. Alternatively, when the legs are rotated in the counterclockwise direction the toy spins to the left.

The preferred embodiment of the toy includes a sound activation device that is responsive to a user clapping their hands. However, other activation means may be employed, such as but not limited to remote control. The toy also includes a speaker to emit sounds when the toy is moving. The toy may also include an outer covering that depicts any animal or even a small child.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
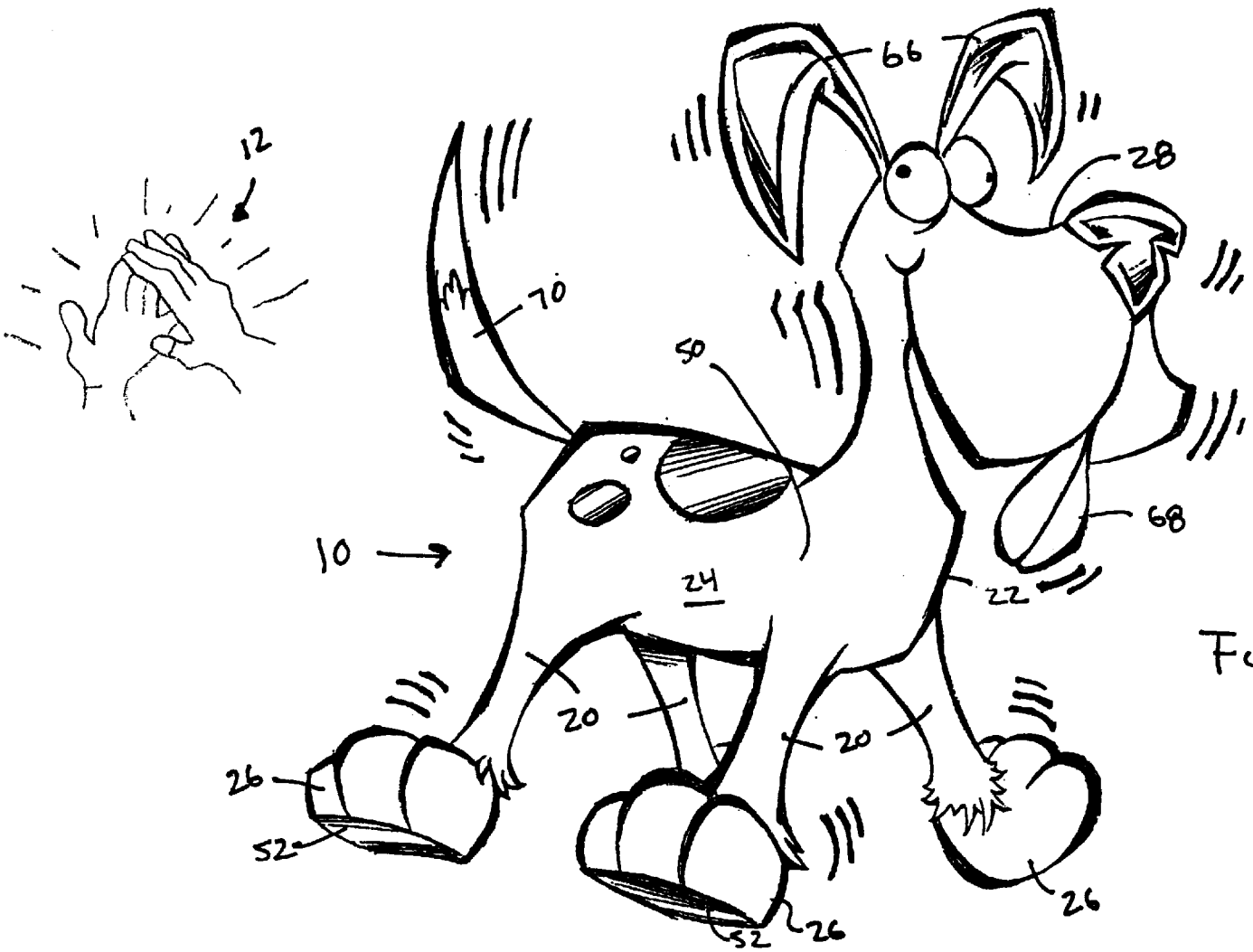
FIG. 1 is a perspective view of the interactive toy that responds to a user clapping their hands.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, an interactive toy is generally referenced herein as number 10. While illustrated as a dog, the outer covering may be changed without deviating from the present invention. As such, the outer covering may represent any animal and even represent a child on its arms and legs. The interactive toy 10 of the present invention reacts to sounds and preferably to a user clapping their hands 12. In response to such sound, the toy 10 moves either forwards or backwards, or spins to the left or right. Additional interactivity may include the toy 10 emitting preprogrammed sounds such as barking or other appropriate and related noises.

Referring now to FIGS. 2–5, the movement is controlled by a pair of motors 14 and 16. The first motor 14, or as illustrated motor A, controls the movement of the legs 20 attached to the left side 22 of the toy 10, while the second motor 16, or as illustrated motor B, controls the movement of the legs 20 attached to the right side 24 of the toy 10. The actual movement is caused by rotating the legs 20 clockwise or counterclockwise, depending on the desired movement. Each leg 20 is attached to a foot 26 and is covered by a loose fabric such that the movement of each leg 20 is only visibly shown as a rotation of the foot 26.

Figure 2A:
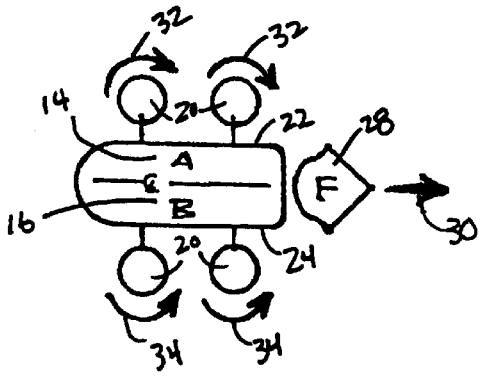
FIGS. 2*a* and 2*b* shows the motor layout and the rotation of the legs necessary to move the interactive toy in a forward direction.
Figure 2B:
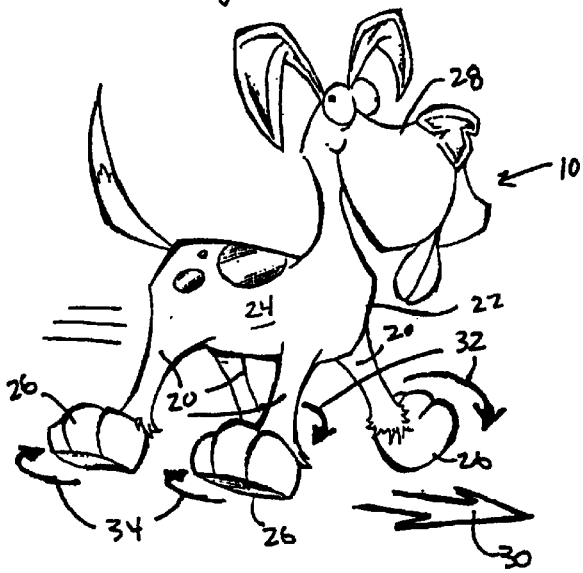
Figure 3A:
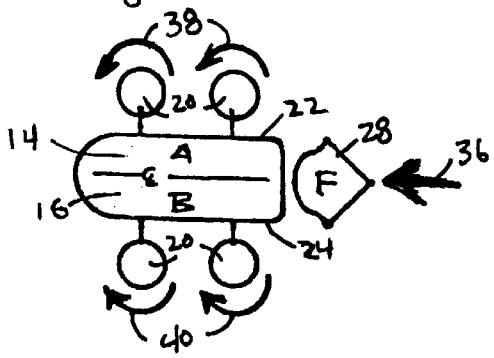
FIGS. 3*a* and 3*b* shows the motor layout and the rotation of the legs necessary to move the interactive toy in a reverse direction.
Figure 3B:
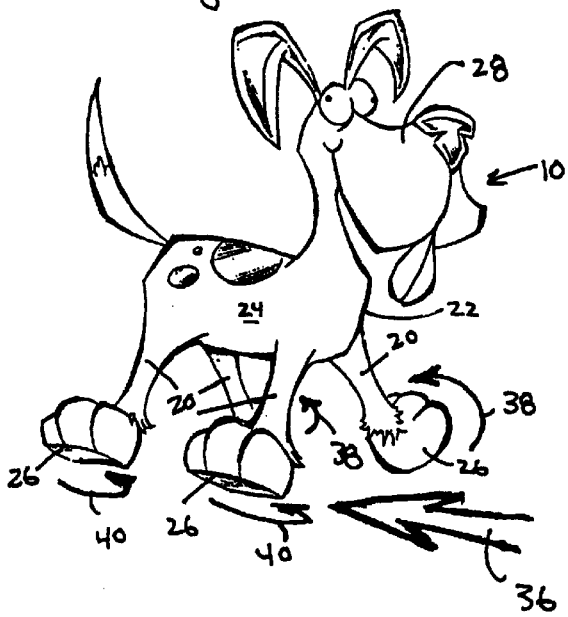

As illustrated in FIGS. 2*a* and 2*b*, when the desired movement is forward 30, from reference of the head 28 of the toy 10, motor A rotates the legs 20 attached to the left side 22 in a clockwise direction 32 and motor B rotates the legs 20 attached to the right side 24 in a counterclockwise direction 34. The combined movement of the legs 20 causes the feet 26 to move the toy 10 forwards 30. When the desired movement is reversed or backwards 36 from reference of the head 28, illustrated in FIGS. 3*a* and 3*b*, motor A moves the legs 20 attached to the left side 22 counterclockwise 38 and motor B moves the legs 20 attached to the right side 24 clockwise 40. As readily apparent from the rotation of the motors, when the pairs of legs move in an opposite direction of each other the resultant movement is either forwards or backwards.

Figure 4A:
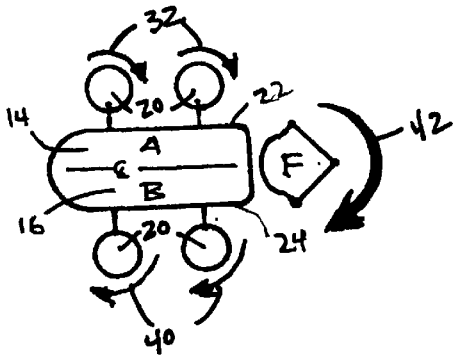
FIGS. 4*a* and 4*b* shows the motor layout and the rotation of the legs necessary to spin the interactive toy towards the right.
Figure 4B:
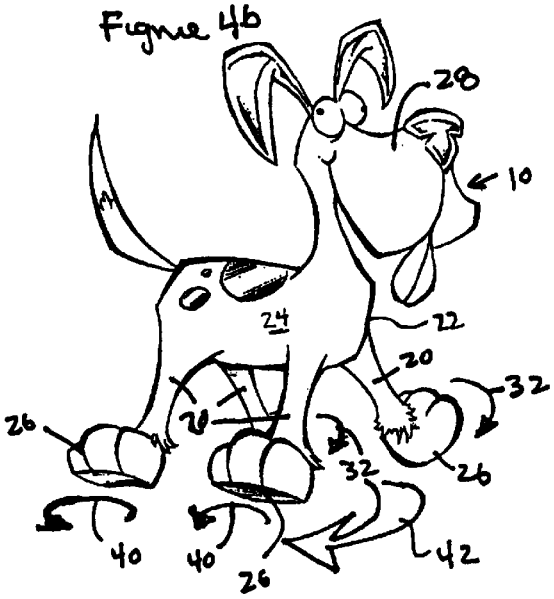
Figure 5A:
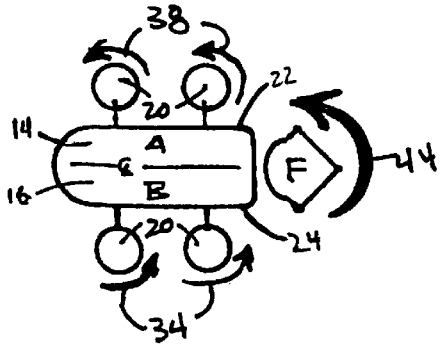
FIGS. 5*a* and 5*b* shows the motor layout and the rotation of the legs necessary to spin the interactive toy towards the left.
Figure 5B:
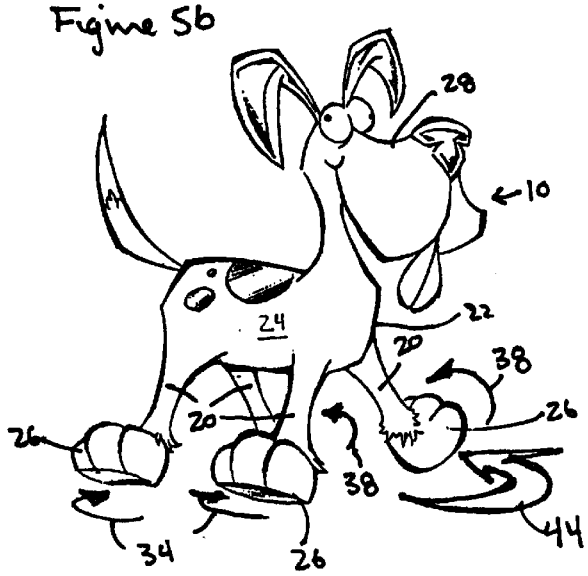

Referring now to FIGS. 4*a* and 4*b*, when the desired movement is to spin the toy to the right 42, from reference of the head 28, motor A rotates the legs 20 attached to the left side 22 clockwise 32 and motor B moves the legs 20 attached to the right side 24 clockwise 40. The combined movement rotates the feet 26 such that the toy 10 spins to the right 42. Alternatively, when the desire movement is to spin the toy to the left 44, FIGS. 5*a* and 5*b*, motor A rotates the legs 20 attached to the left side 22 counterclockwise 38 and motor B moves the legs 20 attached to the right side 24 counterclockwise 34. As readily apparent, when the motors rotate the legs in the same direction, the resultant movement is spinning.

Figures 6A, 6B:
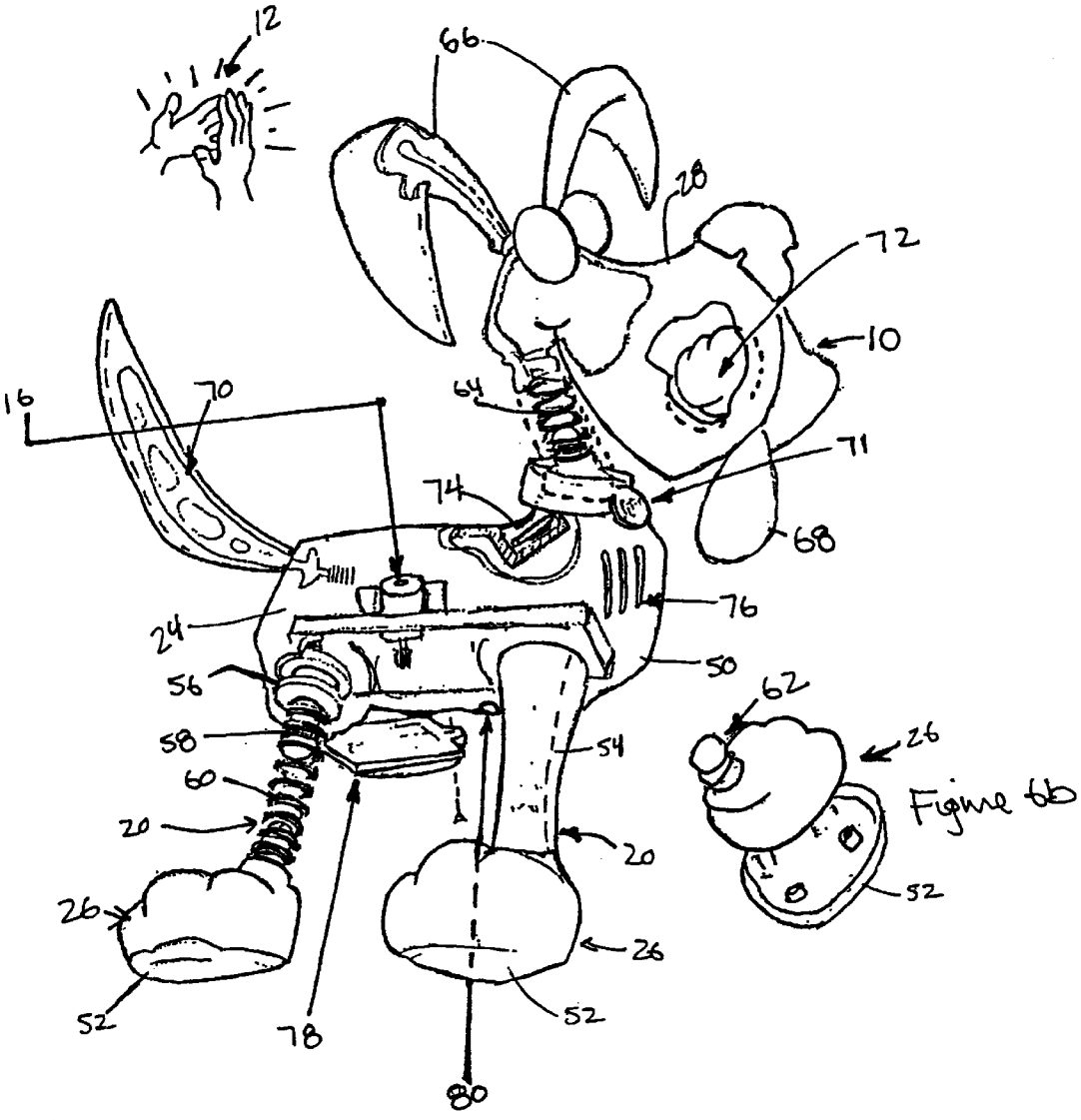
FIG. 6*a* is a perspective view partially illustrating the internal components of the interactive toy.
FIG. 6*b* is a perspective view of one of the feet of the interactive toy.

Referring now to FIG. 6*a*, a partial internal view of the components is illustrated. The preferred toy 10, as mentioned above, includes at least four legs 20, extending outwardly and downwardly from the body 50 of the toy 10. Two of the legs 20 are attached to a first motor A (not shown) on the left side 22 of the toy 10, while the other two legs 20 are attached to a second motor 16 (or motor B), on the right side 24 of the toy 10. Each leg 20 further includes a foot 26 attached at the opposite end of the leg 20, which comes in contact with a surface. The bottom portion 52 of each foot 26 is preferably made of a hard plastic material that provides the necessary friction needed for the movement of any surface. Generally, the bottom portion 52 allows the foot 26 to act like a grip on the surface causing the toy 10 to move without slipping on the surface.

As mentioned above, each leg 20 has an outer covering 54. Internally, each leg 20 has a spool 56, which at one end is rotatably attached to the motor and at the other end has a mounting post 58 to mount one end of a leg spring 60. The leg spring 60 is resilient enough to hold the weight of the toy 10 and mounts by the other end to a second mounting post 62 defined on the end of the foot 26, illustrated in FIG. 6*b*. When the motor rotates the leg 20, the actual movement exhibited is the rotation of the leg spring 60 that partially rotates each foot 26. While not shown, each leg 20 may also be angled outwardly from the body 50 such that each foot 26 comes in contact with the surface at an angle. As the legs 20 rotate quickly, the leg springs 60 and the feet 26 create a bouncing action that moves the toy 10.

The toy 10 also includes a head 28 that is attached to the body 50 by a neck spring 64. The neck spring 64 permits the head 28 to bounce up and down when the toy 10 is moving. Similarly, when the toy 10 is an animal, ears 66 and a tongue 68 may be attached to the head 28 and a tail 70 may be attached to the body 50, all by springs such that the ears 66, tongue 68 and tail 70 may also bounce when the toy 10 is moving. The toy 10 may also be stuffed with fabric 72 to provide a soft cushy texture. Moreover, other characteristics may be attached to the toy 10 to increase the aesthetic qualities of the toy 10, for example a dog collar and tag 71 may be included.

Movement is activated when a user claps their hands 12. A clap sensor 74 is located within the toy 10 and is in communication with an integrated circuit (not shown). The integrated circuit is in further communication and control of the motors. When the user claps their hands 12, the clap sensor 74 activates the motors 14 and 16 in accordance to one of the above mentioned directions. The integrated circuit may randomly choose either one of the directions at any time or may be programmed to cycle through a sequence, such as (1) forward, (2) spin right, (3) spin left, or (4) reverse. The order or sequence is not important to the present invention. The movement typically last for about 8 seconds after which the integrated circuit stops the motors until the user claps their hands again. The integrated circuit may further control a speaker 76 to emit pre-programmed sounds.

The toy 10 is powered by a power supply, preferably batteries (not shown). A battery hatch 78 is located in the bottom portion of the toy 10, to provide easy access for the user to insert and change the batteries. Moreover, the toy 10 may be turned on and off by an on/off switch 80 also located on the bottom portion of the toy 10.

Figure 7:
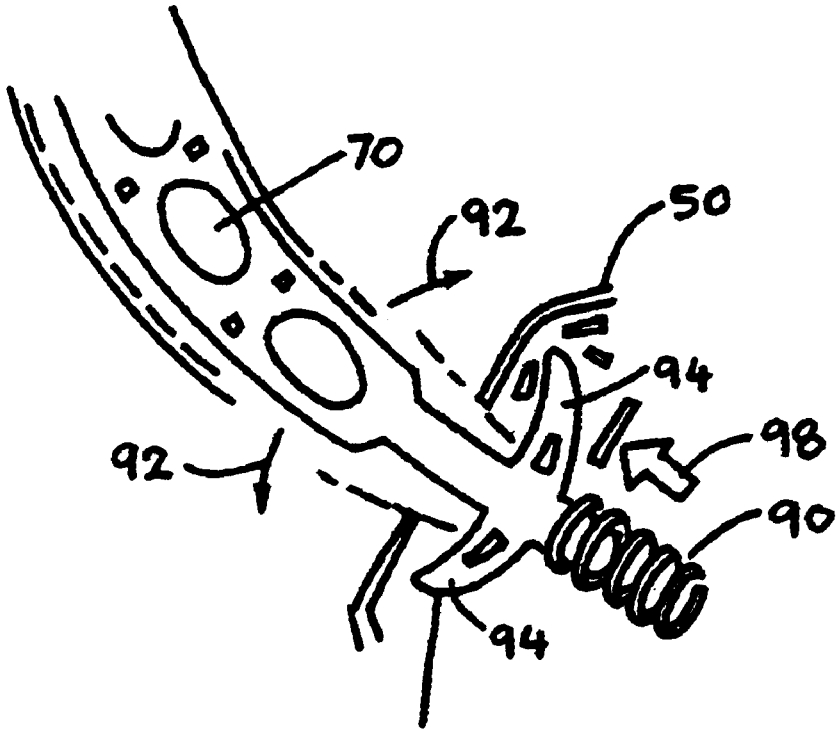
FIG. 7 is an enlarged view illustrating the connection of the tail and the body.

To prevent a user for removing the tail 70 or other free moving appendages, the appendage may include flanges that are positioned within the body 50. Referring now to FIG. 7, the tail 70 is shown attached to the body 50 of the toy 10. The tail 70 is attached to the body 50 by a spring 90, which permits the tail 70 to bounce, arrows 92, when the toy 10 moves. The tail 70 includes a pair of flanges 94 extending outwardly from the tail 70 such that the flanges 94 are larger than the opening 96 in the body for which the tail is received. As such, if the tail is pulled away from the body 50, arrow 98, the flanges 94 will come into contact with the body 50 preventing the tail 70 from being removed from toy 10.

In other embodiments of the present invention, the movement of the toy may be activated and controlled by a remote control unit. A receiver positioned within the toy 10 would be in communication with the integrated circuit. The receiver would receive signals from a remote unit. The signals would specify to the integrated circuit the direction to move the toy 10.

In yet another embodiment of the present invention, the toy may only include a single motor that drives the toy forward when the motor is run in one direction and causes the toy to spin if the motor direction is reversed.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

What is claimed is:

1. A toy comprising a body having a left and right side;

a pair of motors located within the body such that one of the motors is positioned on the left side and the other motor is positioned on the right side; and a pair of legs rotatably attached to the motor on the left side of the body and a pair of legs rotatably attached to the motor on the right side of the body, each leg further includes a foot defined to come into contact with a surface, such that when the pair of motors are activated one or more of the feet rotate to move the toy in a predetermined direction defined by the rotation of the feet.

2. The toy of claim 1, further comprising:

a sound activation device in communication with the motors, such that when the sound activation device detects sound, the sound activation device activates the motors to rotate one or more of the feet to move the toy in a predetermined direction.

3. The toy of claim 2, wherein when the motor on the right side of the body rotates the legs attached thereto in a clockwise direction and the motor on the left side of the body rotates the legs attached thereto in a counterclockwise direction, the toy moves in a reverse direction.

4. The toy of claim 2, wherein when the motor on the right side of the body rotates the legs attached thereto in a counterclockwise direction and the motor on the left side of the body rotates the legs attached thereto in a clockwise direction, the toy moves in a forward direction.

5. The toy of claim 2, wherein when the motor on the right side of the body rotates the legs attached thereto in a clockwise direction and the motor on the left side of the body rotates the legs attached thereto in a clockwise direction, the toy spins to the right.

6. The toy of claim 2, wherein when the motor on the right side of the body rotates the legs attached thereto in a counterclockwise direction and the motor on the left side of the body rotates the legs attached thereto in a counterclockwise direction, the toy spins to the left.

7. The toy of claim 2, wherein each leg includes a leg spring attached on one end to the motor and attached on another end to a foot, wherein the motor drives each leg through said leg springs.

8. The toy of claim 2, further comprising a speaker in communication with a integrated circuit that is in further communication with the sound activation device and the pair of motors such that when the integrated circuit receives an indication from the sound activation device, the integrated circuit activates the motors to move the toy in a predetermined direction and activates the speaker to emit a preprogrammed sound.

9. An interactive toy comprising:

two pair of legs, each pair separately extending outwardly and downwardly from a right or left side of a body, each pair of legs includes leg mounts and are separately and rotatably attached to a motor assembly including a motor mount rotatably attached thereto and positioned either on the right side or left side of the body, respectively;

each leg is defined as having a resilient leg spring secured at one end to the motor mount and secured at the other end to a foot mount; and a sound activation device in communication with an integrated circuit, the integrated circuit is further in communication and control of the motors, wherein when the sound activation device is activated, the integrated circuit controls the motors to rotate the legs such that the toy moves along the surface in a predefined direction.

10. The toy of claim 9, wherein when one of the motors rotates the pair of legs attached thereto in an opposite direction as the pair of legs attached to the other motor, the toy moves either in a forward or reverse direction.

11. The toy of claim 10, wherein when the legs attached to the right side of the body rotate clockwise and the legs attached to the left side of the body rotate counterclockwise, the toy moves in the reverse direction.

12. The toy of claim 10, wherein when the legs attached to the right side of the body rotate counterclockwise and the legs attached to the right side of the body rotate clockwise, the toy moves in the forward direction.

13. The toy of claim 9, wherein when one of the motors rotates the pair of legs attached thereto in a same direction as the other pair of legs, the toy spins to the right or the left.

14. The toy of claim 13, wherein when both pairs of legs rotate clockwise the toy spins to the right and when both pairs of legs rotate counterclockwise the toy spins to the left.

* * * * *